United States Patent [19]

Snyder et al.

[11] Patent Number: 4,693,680

[45] Date of Patent: Sep. 15, 1987

[54] FLAME STABILIZED POST-MIXED BURNER

[75] Inventors: William J. Snyder, White Plains; Hisashi Kobayashi, Putnam Valley, both of N.Y.

[73] Assignee: Union Carbide Corporation, Danbury, Conn.

[21] Appl. No.: 896,211

[22] Filed: Aug. 14, 1986

[51] Int. Cl.[4] ..... F23M 3/04

[52] U.S. Cl. ..... 431/10; 431/190; 431/187

[58] Field of Search ..... 431/8, 10, 187, 181, 431/190

[56] References Cited

U.S. PATENT DOCUMENTS

| | | | |
|---|---|---|---|
| 3,330,485 | 7/1967 | Misner | 239/419 |
| 3,529,917 | 9/1970 | Hindenlang | 431/351 |
| 3,663,153 | 5/1972 | Bagge et al. | 431/351 |
| 3,711,243 | 1/1973 | Zink et al. | 431/351 |
| 3,788,796 | 1/1974 | Krippene et al. | 431/2 |
| 4,105,395 | 8/1978 | Goodnight et al. | 431/351 |
| 4,181,491 | 1/1980 | Hovis | 431/190 |
| 4,378,205 | 3/1983 | Anderson | 431/5 |
| 4,402,666 | 9/1983 | Glomm et al. | 431/177 |
| 4,431,400 | 2/1984 | Kobayashi et al. | 431/6 |
| 4,439,137 | 3/1984 | Suzuki et al. | 431/10 |
| 4,488,682 | 12/1984 | Kobayashi et al. | 239/132.3 |
| 4,525,138 | 6/1985 | Snyder et al. | 431/187 |
| 4,541,796 | 9/1985 | Anderson | 431/187 |
| 4,541,798 | 9/1985 | Miller et al. | 431/266 |

FOREIGN PATENT DOCUMENTS

| | | | |
|---|---|---|---|
| 54-340 | 4/1979 | Japan | 431/181 |

*Primary Examiner*—Carroll B. Dority, Jr.
*Attorney, Agent, or Firm*—Stanley Ktorides

[57] ABSTRACT

A burner and method enabling operation of a post-mixed burner having radially spaced fuel and main oxidant injection points with a stable flame without the need of a separate oxidant annulus proximate the fuel stream characterized by defined relationships enabling passing stabilizing oxidant from the main oxidant stream into the fuel stream upstream of their injection into the combustion zone wherein the stabilizing oxidant velocity decreases from that of the main oxidant and the stabilizing oxidant passage flow area increases at the fuel stream communication with respect to an upstream restriction.

18 Claims, 1 Drawing Figure

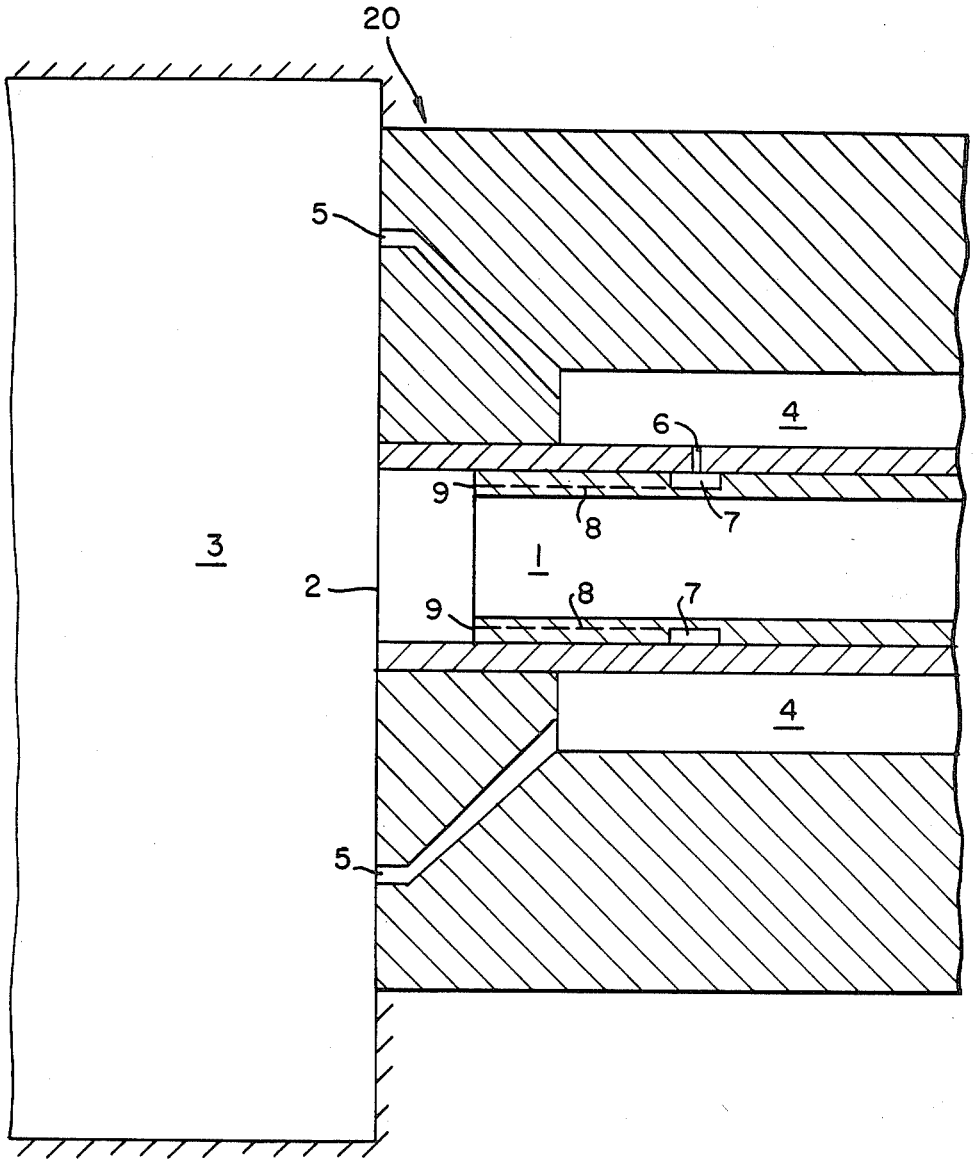
20
5
4
6
9
8
7
3
1
2
9
8
7
4
5

FLAME STABILIZED POST-MIXED BURNER

TECHNICAL FIELD

This invention relates generally to post-mixed burners and is an improvement whereby the burner may be operated with a stable flame without need of a separate oxidant annulus.

BACKGROUND ART

In order to maintain the safety of a combustion system, a burner with a stable flame is required. Flame stability of a burner is that quality of a burner which enables it to remain lighted over a wide range of firing rate and fuel/oxidant mixture ratios under practical furnace conditions. Flame stability of a burner is a complex phenomenon influenced, inter alia, by the geometry of the burner and the burner block, the flow conditions of fuel and oxidant, and the temperature conditions of the furnace and the burner block. It is generally believed that the recirculation of hot combustion products near the burner face where fuel and oxidant start to mix is beneficial in enhancing the flame stability of a burner. In order to obtain the desired effects, most air burners are designed with a burner block and often with a swirl in the combustion air flow.

A recent significant advance in the burner art is the aspirator burner and process developed by Dr. J. E. Anderson and described and claimed in U.S. Pat. Nos. 4,378,205 and 4,541,796. By means of this aspirator burner and process one can advantageously employ enriched air and even pure oxygen as the oxidant with resulting significantly improved operating efficiencies. This burner is characterized by a large radial distance between the fuel and oxidant injection points and a relatively high velocity for the oxidant. The flame in a burner such as the aforementioned aspirator burner may be stabilized by the introduction of a small amount of oxygen in an annular stream proximate the fuel stream. A very stable flame is obtained with this arrangement for a broad range of firing conditions.

Flame stabilization by means of a small annular oxidant stream proximate the fuel stream is very effective but is costly and complicated. Two passages must be present in the burner to bring the separate oxidant flows to the face of the burner where they can react with the fuel. This increases the size of the burner and therefore its manufacturing costs. There is also required two separate oxidant supplies, one for the main oxidant and one for the stabilizing annular oxidant. This entails additional piping to the burner, additional valving to control the two oxidant flows, and increased piping and wiring costs to install these additional components. In addition, an annular oxygen passage hinders the cooling of the fuel tube by the water-cooled burner head causing excessive temperatures in this area.

It is therefore an object of this invention to provide a post-mixed burner apparatus and process having fuel and oxidant injection points spaced radially apart which operates with a stable flame without the need for an annular oxidant stream proximate the fuel stream.

SUMMARY OF THE INVENTION

The above and other objects which will become apparent to one skilled in the art upon a reading of this disclosure are attained by the present invention one aspect of which is:

A post-mixed burner comprising:

(1) a fuel passage having an end for injecting fuel into a combustion zone;

(2) a main oxidant passage having at least one end for injecting oxidant into the combustion zone and having a total area $A_1$ at the injection point(s), said end(s) being radially spaced from the fuel passage end; and (3) a stabilizing oxidant passage communicating with both the fuel and main oxidant passages upstream of their respective ends, said stabilizing oxidant passage having a total area $A_2$ where it communicates with the fuel passage and a restriction having an area $A_3$ upstream of where it communicates with the fuel passage wherein the ratio $A_3/(A_1+A_3)$is not more than 0.1 and the ratio $A_3/A_2$ is not more than 0.7.

Another aspect of the present invention is:

A method of operating a post-mixed burner comprising:

(1) injecting a fuel stream into a combustion zone;

(2) injecting a main oxidant stream into the combustion zone at a velocity equal to or greater than 500 feet per second at a point radially spaced from the fuel stream injection point; and (3) passing stabilizing oxidant from the main oxidant stream into the fuel upstream of their respective injection points, said stabilizing oxidant having a velocity at the point where it passes into the fuel stream which is not more than 350 feet per second and having a flowrate which is not more than 10 percent of that of the main oxidant stream.

BRIEF DESCRIPTION OF THE DRAWINGS

The sole FIGURE is an axial cross sectional view of one embodiment of the post-mixed burner of this invention.

DETAILED DESCRIPTION

The burner apparatus and method of this invention will be described in detail with reference to the drawing.

Referring now the FIGURE, within cylindrical burner 20 fuel passes through fuel passage 1 to end 2 and is injected into furnace zone or combustion zone 3. The fuel may be any combustible fuel and preferably is a gaseous fuel such as natural gas, methane or coke oven gas.

Oxidant passes through main oxidant passage 4 to end 5 where it also is injected into combustion zone 3. The oxidant may be oxygen enriched air or pure oxygen. Preferably the oxidant has an oxygen concentration of at least 30 percent. A particularly preferred oxidant is pure oxygen.

The respective ends of the fuel and main oxidant passages are radially spaced from each other along the burner face, i.e. at the points where the fuel and oxidant are injected into the combustion zone. This radial spacing may be any effective spacing and is generally at least two oxidant nozzle diameters. One preferred radial spacing when the oxidant is oxygen is a distance of at least 4 oxidant nozzle diameters, most preferably from 4 to 20 oxidant nozzle diameters, when the oxidant is supplied to the combustion zone as a circular oxidant stream. When the oxidant is supplied to the combustion zone as an annular stream, the radial spacing is preferably at least 4 times the radial distance of the annular opening and most preferably from 4 to 20 times this radial distance. A preferred arrangement includes fuel passage 1 as a central fuel passage and main oxidant passage 4 as a coaxial outer oxidant passage which then divides into two or more distinct oxidant passages, most preferably from four to eight equidistantly spaced oxidant passages, prior to the end(s) where the oxidant is injected into the furnace zone.

The firing rate of the burner may be from as low as 0.5 to as high as 20 or more million BTU per hour. The dimensions of the burner will vary in accord with its maximum designed firing rate. Generally, the main oxidant passage at the point or points where the oxidant is injected into the furnace zone has a total area $A_1$ which is within the range of from 0.0736 to 0.1731 square inch. The oxidant passes through main oxidant passage 4 and through end(s) 5 into combustion zone 3 at a velocity equal to or greater than 500 feet per second and preferably within the range of from 500 to 1366 feet per second, and at a flowrate of from 1000 to 6000 standard cubic feet per hour.

Communicating with both fuel passage 1 and main oxidant passage 4 upstream of their respective ends is a stabilizing oxidant passage which has a total area $A_2$ at the point(s) where it communicates with the fuel passage which is generally within the range of from 0.0113 tto 0.053 square inch. Upstream of where the stabilizing oxidant communicates with the fuel passage the stabilizing oxidant passage contains a restriction having a cross sectional area $A_3$ at its narrowest point generally within the range of from 0.005 to 0.0184 square inch. The stabilizing oxidant has a velocity at the point where it passes into the fuel stream of at most 350 feet per second, preferably within the range of from 100 to 250 feet per second, and most preferably about 200 feet per second and generally has a velocity at least 30 percent less and preferably has a velocity within the range of from 67 to 75 percent less than the velocity of the main oxidant stream. The stabilizing oxidant has a flowrate within the range of from 3 to 10 percent, and preferably within the range of from 5 to 10 percent of the flowrate of the main oxidant stream.

The FIGURE illustrates a preferred arrangement for the stabilizing oxidant passage. Referring now to the FIGURE, oxidant passage 4 communicates with orifice 6 within the wall between the fuel and oxidant passage. Orifice 6 has a cross-sectional area $A_3$ and in turn communicates with annular groove 7 which serves as a manifold to distribute stabilizing oxidant to a plurality of slots 8 which pass the stabilizing oxidant into the fuel at a plurality of points 9. Preferably the slots 8 are disposed circumferentially between the main oxidant injection ends and thus in the FIGURE the slots 8 are shown as dotted lines. The total cross-sectional area of injection points 9 is defined as $A_2$. While the FIGURE illustrates one orifice 6, the burner of this invention may employ a plurality of orifices with the area $A_3$ being the total area of the orifices.

The burner of this invention encompasses two important relationships. The first relationship is $A_3/(A_1+A_3)$ not more than 0.1. This relationship defines the percentage of stabilizing oxidant restriction area to total oxidant area and serves to ensure that the flowrate of the stabilizing oxidant is not more than 10 percent of the main oxidant flowrate. A stabilizing oxidant flowrate exceeding 10 percent of the main oxidant flowrate, especially if pure oxygen is the oxidant, will create a very hot condition at the point where fuel and stabilizing oxidant mix and could lead to damage to the burner or to increased $NO_x$ formation.

The second important burner relationship is $A_3/A_2$ not more than 0.7. This defines the relationship between the stabilizing oxidant restriction area to the stabilizing oxidant injection area and serves to ensure that the velocity of the stabilizing oxidant will be significantly reduced from that of the velocity of the main oxidant stream. This reduction in velocity enables the attainment of a stable flame. A stabilizing oxidant velocity at the points of injection into the fuel in excess of 350 feet per second will not provide a stable flame.

As indicated, the stabilizing oxidant is passed into the fuel stream upstream of its point of injection into the combustion zone. This recess is generally within the range of from 0.1 to 1.0 inch and preferably within the range of from 0.2 to 0.4 inch. A recession greater than about 1.0 inch may cause overheating and a recession less than about 0.1 inch may cause instability.

The following example serves to further illustrate the apparatus and process of this invention. The example is presented for illustrative purposes and is not intended to be limiting.

A burner of the embodiment illustrated in the FIGURE was employed to fire a furnace. The burner employed six separate main oxidant injection ends having a total flow area of 0.1657 square inch. The fuel employed was natural gas and the oxidant employed was pure oxygen at a velocity of 1366 feet per second. The stabilizing oxidant passage had an orifice cross-sectional flow area of 0.01005 square inch and a total flow area at the stabilizing oxidant outflow into the fuel of 0.0399 square inch. Thus, the relationship $$\frac{A_3}{A_1 + A_3} = \frac{0.01005}{0.1657 + 0.01005} = 0.057$$

and the relationship $$\frac{A_3}{A_2} = \frac{0.01005}{0.0399} = 0.251.$$

The velocity of the stabilizing oxygen as it entered the fuel passage was 343 feet/second which was a 74.9 percent reduction over the main oxidant velocity. The stabilizing oxygen flow was 5.7 percent of the total stoichiometric oxygen flow. The burner was operated at a number of different fuel velocities which ranged from as low as 10 to as high as 513 feet/second. The burner operated with a stable flame over the entire range of fuel velocities.

For comparative purposes the following comparative examples are also reported.

A burner which was similar to that used in the above example, except that the stabilizing oxidant passage had a constant flow area (0.0552 square inch), was employed to fire a furnace. Thus the relationship $A_3/A_2=1.0$. The fuel employed was natural gas and the oxidant employed was pure oxygen. The velocity of the main oxidant was 510 feet/second. Since there was no increase in flow area in the stabilizing oxidant passage there was no decrease in stabilizing oxidant velocity as it entered the fuel passage. The burner was operated at several different fuel velocities which ranged from 30 to 108 feet/second. The flame was not stable and it blew off the burner.

Another burner, which was similar to that used in the above example, except that the stabilizing oxidant passage consisted a series of slots having the same flow area (0.00844 square inch) in communication with both the fuel and main oxidant passages, was employed to fire a furnace. The fuel employed was natural gas and the oxidant employed was pure oxygen. The velocity of the main oxidant was 495 feet/second. Since there was no increase in flow area of the slots, there was no decrease in oxidant velocity. The burner was operated at several different fuel velocities which ranged from 10 to 170 feet/second. The flame was very unstable.

Now with the burner apparatus and method of this invention one can operate a post mixed burner having radially spaced fuel and oxidant injection ports with a stable flame without need of an oxidant annulus proximate the fuel stream.

Although the burner and method of this invention have been described in detail with reference to a certain illustrated embodiment, it is understood that there are a number of other embodiments of this invention within the spirit and scope of the claims.

We claim:

1. A post-mixed burner comprising:

(a) a fuel passage having an end for injecting fuel into a combustion zone;

(b) a main oxidant passage having at least one end for injecting oxidant into the combustion zone and having a total area $A_1$ at the injection point(s), said end(s) being radially spaced from the fuel passage end; and (c) a stabilizing oxidant passage communicating with both the fuel and main oxidant passages upstream of their respective ends, said stabilizing oxidant passage having a total area $A_2$ where it communicates with the fuel passage and a restriction having an area $A_3$ upstream of where it communicates with the fuel passage wherein the ratio $A_3/(A_1+A_3)$ is not more than 0.1 and the ratio $A_3/A_2$ is not more than 0.7.

2. The burner of claim 1 wherein the fuel passage is a central tube and the main oxidant passage is an annular passage coaxial with the fuel passage which divides into a plurality of oxidant injection passages to inject oxidant into the combustion zone from a plurality of injection points.

3. The burner of claim 1 wherein the area $A_1$ is within the range of from 0.0736 to 0.1731 square inch.

4. The burner of claim 1 wherein the area $A_2$ is within the range of from 0.0113 to 0.053 square inch.

5. The burner of claim 1 wherein the area $A_3$ is within the range of from 0.005 to 0.0184 square inch.

6. The burner of claim 1 wherein the stabilizing oxidant passage comprises an orifice communicating with the main oxidant passage and with an annular distribution groove, and a plurality of slots communicating with the distribution groove and with the fuel passage.

7. The burner of claim 1 wherein the main oxidant and fuel passages are radially spaced by at least two oxidant nozzle diameters at their respective points of injection.

8. The burner of claim 1 wherein the stabilizing oxidant passage communicates with the fuel passage at a distance within the range of from 0.1 to 1.0 inch upstream of the fuel passage end.

9. A method of operating a post-mixed burner comprising:

(a) injecting a fuel stream into a combustion zone;

(b) injecting a main oxidant stream into the combustion zone at a velocity equal to or greater than 500 feet per second at a point radially spaced from the fuel stream injection point; and (c) passing stabilizing oxidant from the main oxidant stream into the fuel stream upstream of their respective injection points, said stabilizing oxidant having a velocity at the point where it passes into the fuel stream which is not more than 350 feet per second and having a flowrate which is not more than 10 percent of that of the main oxidant stream.

10. The method of claim 9 wherein the fuel is natural gas.

11. The method of claim 9 wherein the oxidant is pure oxygen.

12. The method of claim 9 wherein the oxidant is enriched air having an oxygen concentration of at least 30 percent.

13. The method of claim 9 wherein from about 3 to 10 percent of the oxidant flowing in the main oxidant stream passes as stabilizing oxidant into the fuel stream upstream of the injection points.

14. The method of claim 9 wherein the reduction in stabilizing oxidant velocity where it passes into the fuel stream compared with the velocity of the main oxidant stream is at least 30 percent.

15. The method of claim 9 wherein the velocity of the stabilizing oxidant where it passes into the fuel stream is within the range of from 100 to 250 feet per second.

16. The method of claim 9 wherein the reduction in the stabilizing oxidant velocity where it passes into the fuel stream compared with the velocity of the main oxidant stream is from 67 to 75 percent.

17. The method of claim 9 wherein the stabilizing oxidant is passed into the fuel stream at a distance within the range of from 0.1 to 1.0 inch upstream of the fuel stream injection point.

18. The method of claim 9 wherein the velocity of the main oxidant stream is within the range of from 500 to 1366 feet per second.

* * * * *